US005672080A

United States Patent [19]

Gauthier

[11] Patent Number: 5,672,080

[45] Date of Patent: Sep. 30, 1997

[54] WATER BICYCLE

[75] Inventor: André Gauthier, Sherbrooke, Canada

[73] Assignee: Surfbike Products Inc., Sherbrooke, Canada

[21] Appl. No.: 728,265

[22] Filed: Oct. 8, 1996

[51] Int. Cl.[6] ..... B63H 16/20

[52] U.S. Cl. ..... 440/27; 114/363; 114/162

[58] Field of Search ..... 440/13–15, 12, 440/21, 24–32, 54; 441/79, 65; 114/144 R, 146, 170, 172, 162, 165, 167, 343, 363, 345, 352–354, 221 R

[56] References Cited

U.S. PATENT DOCUMENTS 4,249,276 2/1981 Snyderman ..... 114/345

4,398,485 8/1983 Dizière ..... 441/79

5,362,264 11/1994 Parant ..... 440/31

*Primary Examiner*—Edwin L. Swinehart

*Attorney, Agent, or Firm*—ROBIC

[57] ABSTRACT

The water bicycle has three basic components: an elongated floatation board, a propulsion and seat unit which is releasably connectable to a central portion of the board, and a steering unit which is also releasably connectable to the board, in front of the propulsion and seat unit. These two units are respectively inserted into an opening and a bore provided in the board and are releasably locked therein by snap connectors of the self-binding type. Such locking makes the components quicker and easier to assemble and dissemble.

7 Claims, 9 Drawing Sheets

WATER BICYCLE

FIELD OF THE INVENTION

The present invention is concerned with improvements to the structure of the water bicycle forming the subject matter of U.S. Pat. No. 5,362,264 issued on Nov. 8, 1994 to Pierre-Louis PARANT.

BRIEF DESCRIPTION OF THE PRIOR ART

U.S. Pat. No. 5,362,264 discloses and claims a water bicycle made of a plurality of distinct components including a floatation board, a steering unit and a propulsion and seat unit, that can be quickly assembled and disassembled whenever desired. Such allows for an easy transportation of the water bicycle in a car, and a compact storage of the disassembled components.

In this patent, the propulsion and seat unit is releasably connected to the board by means of bolts that must be screwed either manually or with a tool in order to fix the unit via a mounting flange onto the top surface of the board. In another embodiment shown in FIG. 4 of the patent, the propulsion and seat unit is connected to the board by means of a quick release mechanism including a pair of spring-loaded hooks projecting upwardly from the board so as to engage a cavity provided for this purpose in the unit.

In the same patent, the rudder of the steering unit is releasably connected to the shaft of the handle bar of this unit by means of a pin which must be engaged into corresponding holes made in the rudder and shaft, respectively. Such involves a manual alignment of the holes, which is sometimes difficult to achieve.

SUMMARY OF THE INVENTION

The object of the present invention is to provide a water bicycle which is of the same type as disclosed in U.S. Pat. No. 5,362,264 but whose components are quicker and easier to assemble and disassemble.

Like the one disclosed in U.S. Pat. No. 5,362,264, the water bicycle according to the invention comprises three basic components, namely:

an elongated floatation board having a bow, a central portion and a stern;

a propulsion and seat unit which is releasably connectable to the board; and a steering unit which is also releasably connectable to the board, in front of the propulsion and seat unit.

The propulsion and seat unit includes an upper body portion with a seat fixed on top of it. Foot pedals are connected to a crank gear fixed into the upper body portion below the seat for use by a person sitting on the seat The unit also includes a lower body portion. A propeller is operatively mounted onto the lower body portion and operatively connected to the crank-gear by suitable coupling means. The unit further includes positioning means preferably in the form of a rectangular box, including a mounting flange projecting outwardly from the unit between the upper and lower body portions thereof.

Means are provided, which defines an opening in the central portion of the board through which the lower body portion and propeller may pass. The opening that is so defined is sized to snugly receive the positioning means and includes a recess defining a surrounding edge surface on top of the board, which is sized to receive the mounting flange of the positioning means.

Means are also provided for releasably connecting the propulsion and seat unit to the board after insertion of the positioning means within the opening made in the board.

The steering unit includes a vertical shaft having a top end and a bottom end. A handle bar extends transversally on top of the shaft. A retaining ring radially projects from the shaft at a distance from the bottom end of the same. The steering unit also includes a rudder and means for releasably connecting the rudder to the bottom end of the shaft.

Means are provided, which defines a bore in the central portion of the board at a distance forwards from the opening. This bore is sized to receive the bottom end of the shaft which is rotatably retained therein by means of the retaining ring.

As aforesaid, this structure is known per se. However, in accordance with the invention, it is substantially improved in that:

the means for releasably connecting the rudder to the bottom end of the shaft are of the self-binding type, thereby making connection of the rudder to the shaft easy to carry out after the bottom end of this shaft has been inserted into the bore in the board; and the means for releasably connecting the propulsion and seat unit to the board are also of the self-binding type, thereby making connection of the propulsion and seat unit to the board very quick and easy to carry out.

The expression "of self-binding type" is intended to designate any kind of snap connector similar to, for example, the conventional binders that are used on skis to releasably connect the boots of a skier.

The invention and its advantages will be better understood upon reading the following non-restrictive description of a preferred embodiment thereof, made with reference to the accompanying drawings.

DESCRIPTION OF A PREFERRED EMBODIMENT OF THE INVENTION

Figure 2:
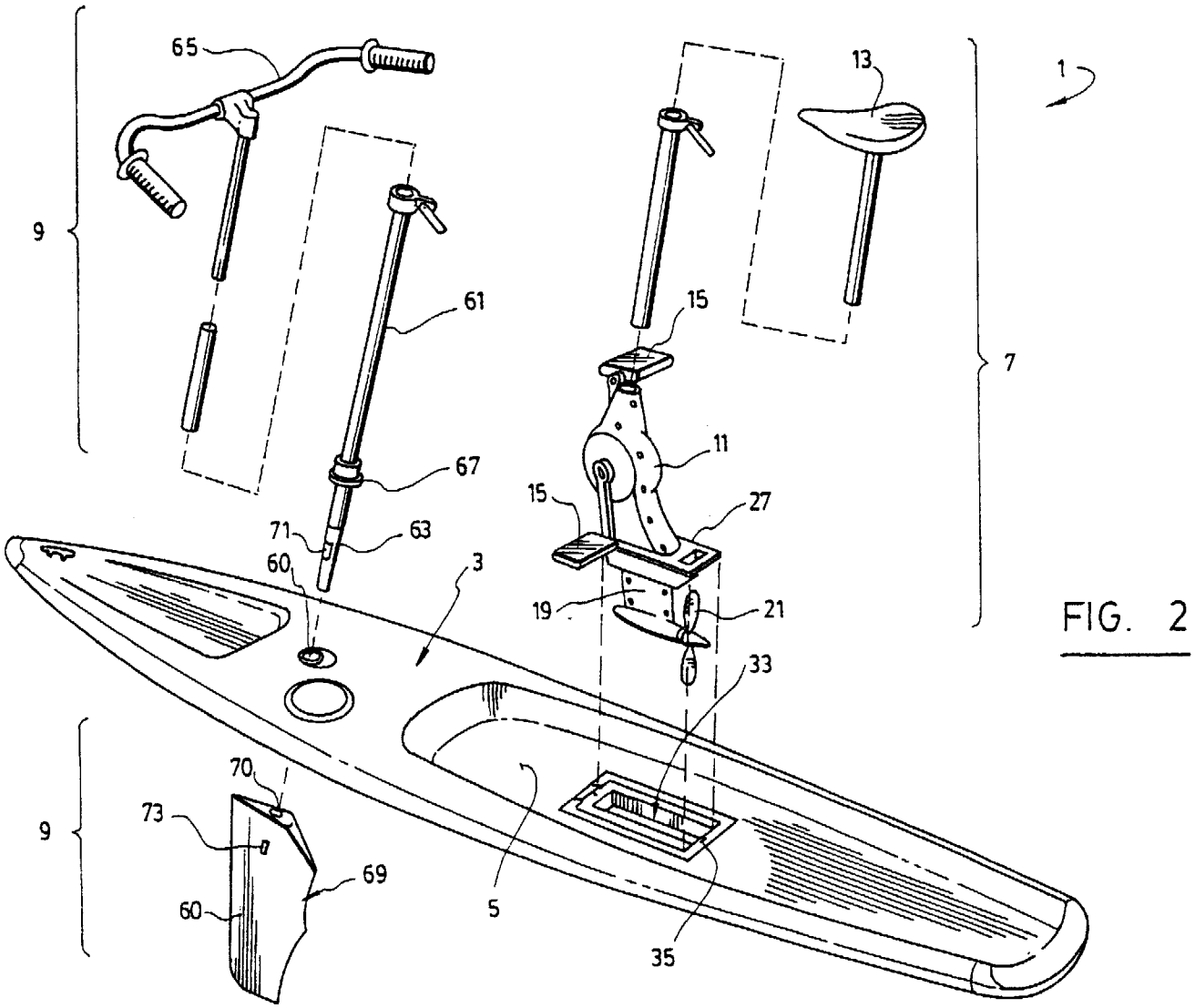
FIG. 2 is an exploded top perspective view of the water bicycle shown in FIG. 1.

The water bicycle 1 according to the preferred embodiment of the invention as shown in FIG. 2 to . . . has a basic structure which is very similar to the one disclosed and claimed in U.S. Pat. No. 5,362,264. This water bicycle comprises three basic components, namely:

an elongated floatation board 3 similar to a surfboard, having a bow, a central portion 5 and a stern;

a propulsion and seat unit 7 which is releasably connectable to the central portion of the board 3; and a steering unit 9 which is also releasably connectable to the board 1, in front of the propulsion and seat unit 7.

Like in the water bicycle of U.S. Pat. No. 5,362,264, a free space is left between the propulsion and seat unit 7 and the steering unit 9 for use by a user to pull him or herself onto the board and then stand up. Thus, it becomes much easier for the user to climb again on the board and seat back on the propulsion and seat unit in the case of a fall, especially in deep water.

Figure 1:
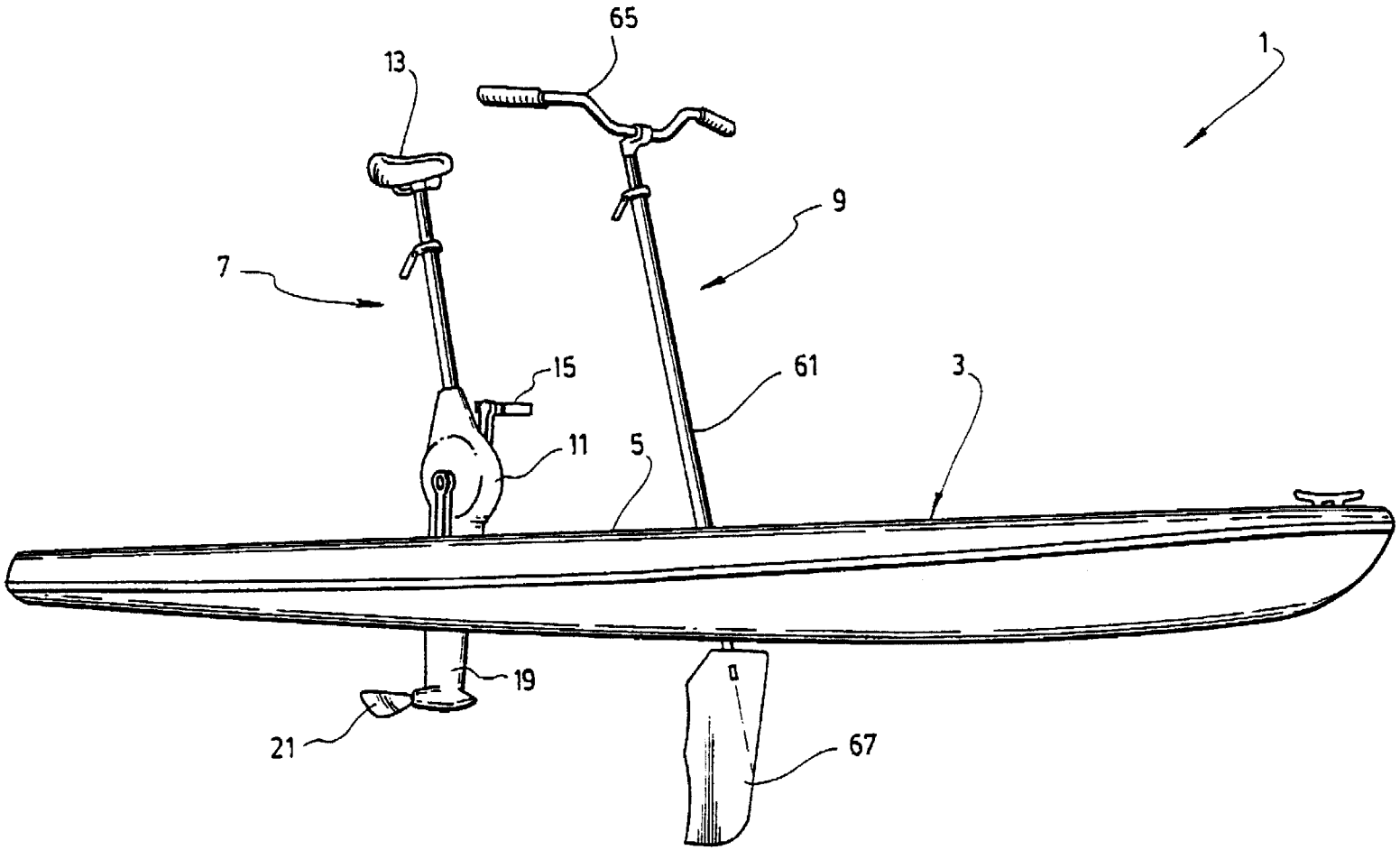
FIG. 1 is a side perspective view of water bicycle according to the invention.
Figure 3:
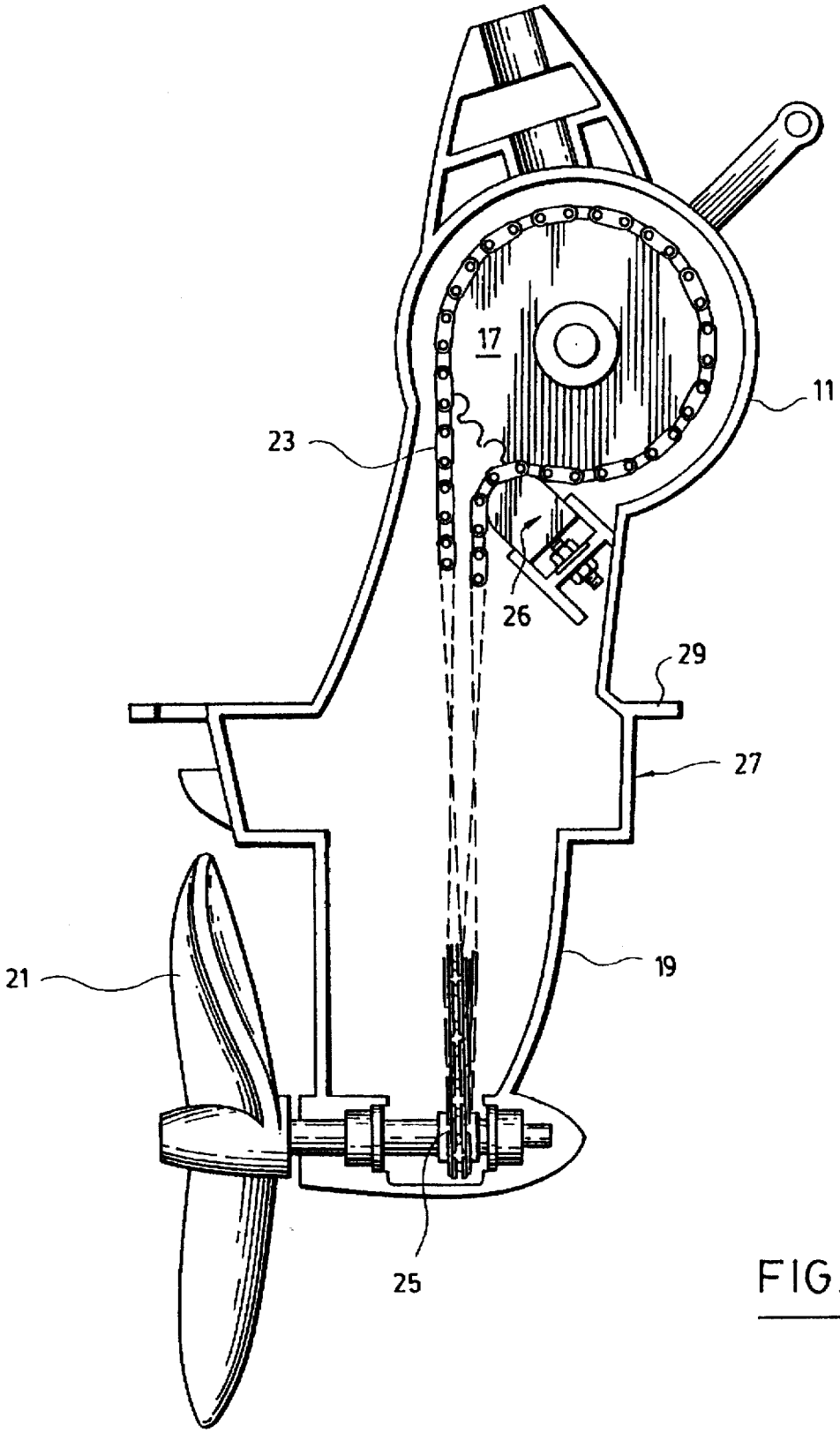
FIG. 3 is a side elevational, cross-section view of the propulsion unit of the water bicycle shown in FIGS. 1 and 2.

As is shown in FIGS. 1 to 3, the propulsion and seat unit 7 includes an upper body portion 11 having a seat 13 fixed on top of it. The unit 7 also includes foot pedals 15 connected to a crank gear 17 fixed into the upper body portion 11 below the seat for use by a person sitting on the seat. The unit 7 further includes a lower body portion 19 having a propeller 21 operatively mounted thereof. This propeller 21 preferably consist of a two-blade in-line propeller able to pass easily through an opening provided for this purpose in the board as will be better explained hereinafter.

Coupling means are provided within the upper an lower body portions 11 and 19 for operatively connecting the crank-gear 17 to the propeller 21.

As is shown in FIGS. 3 the coupling means preferably includes a chain 23 interconnecting the crank gear 17 to a sprocket 25 connected to the propeller 21. This chain 23 is held under tension by an adjustable pad 26 made of Nylon or any similar non-fiction material, in such a manner as to get twisted along a linear portion thereof. Such allows for a direct connection of the crank gear 17 to the sprocket 25 in spite of their respective axial positions at an angle of 90° from each other. In place of a pad 26, use could be made of another sprocket.

Last of all, the propulsion and seat unit 7 includes positioning means in the form of a rectangular box 27, which includes on top of it a mounting flange 29 projecting outwardly from the unit 7 between the upper and lower body portions 11, 19 thereof.

As is shown, the upper body portion 11, the box 27 and the lower body portion 19 altogether form a closed housing that may consist of two plastic-molded half shells which encase the crank-gear 17 and the coupling means 23, 25.

Figure 4:
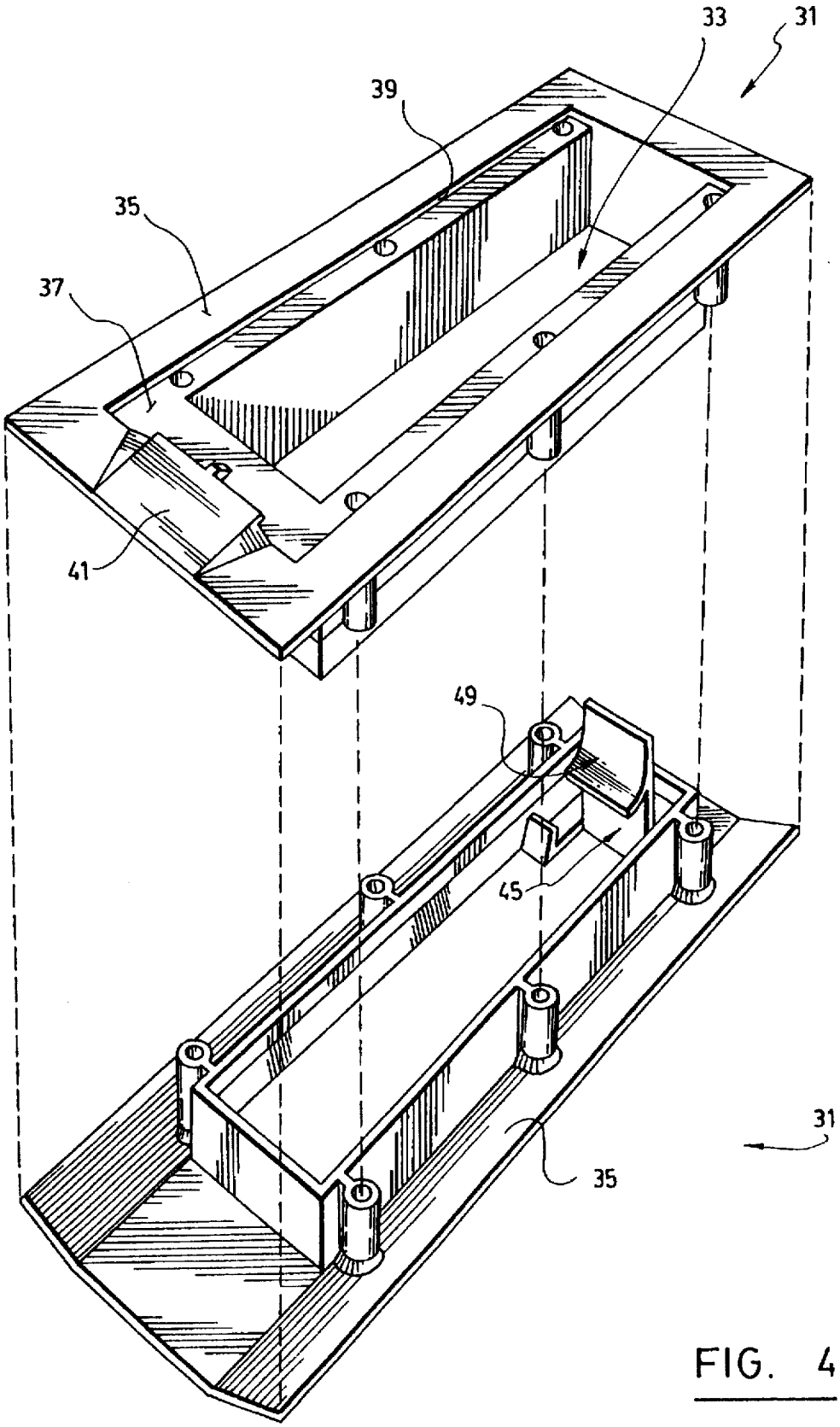
FIG. 4 is an exploded top perspective view of the sleeve in which the propulsion unit may be inserted and locked.
Figure 5:
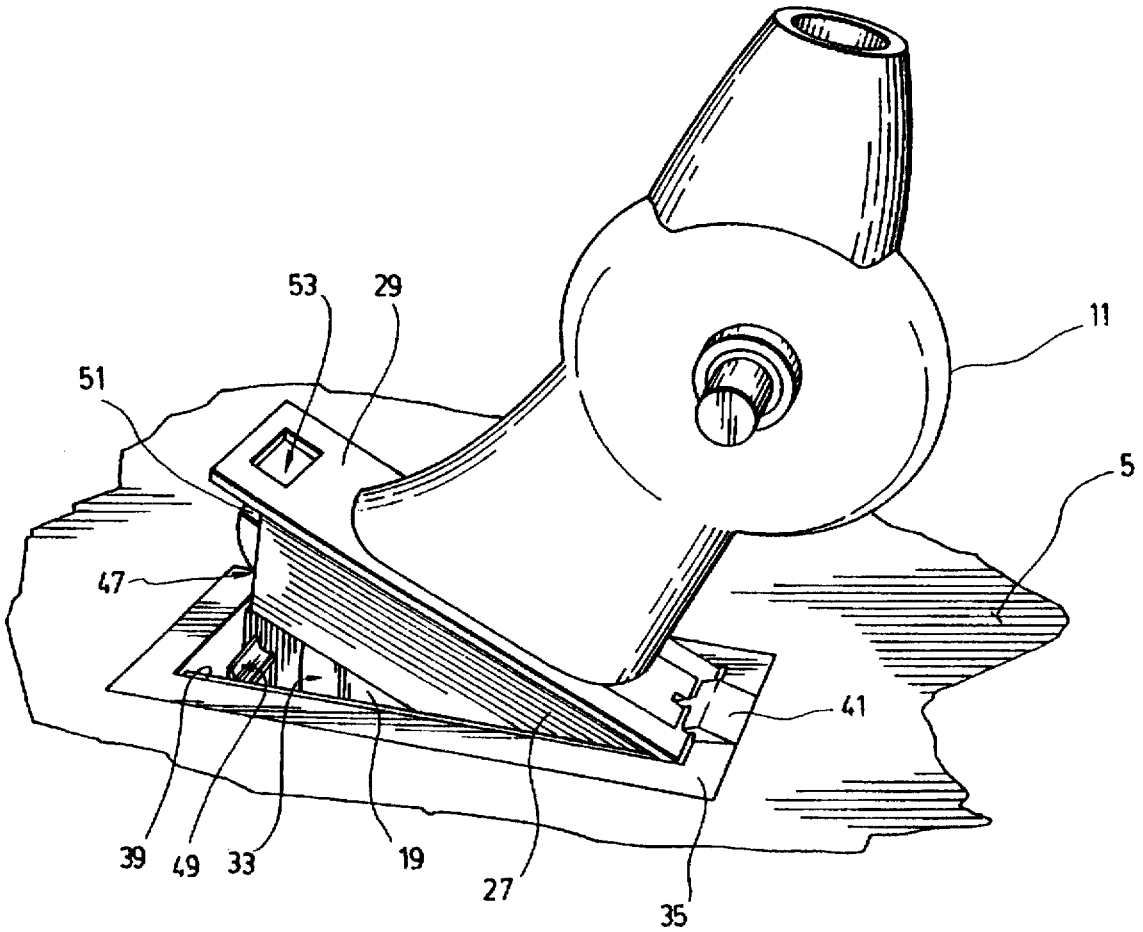
FIG. 5 is a top perspective view of the central portion of the board of the water bicycle shown in FIGS. 1 and 2, while the propulsion unit is installed.

Means 31 are provided, which defines an opening 33 in the central portion 5 of the board 3 through which the lower body portion 19 and propeller 21 may pass. These means 31 are shown in FIG. 4. They preferably consist of a rectangular sleeve that is made of rigid plastic material and is rigidly fixed to the board 5 by means of flanges 35. The opening 33 defined by this sleeve is sized to snugly receive the box 27 acting as positioning means. This opening 33 includes a recess 37 defining a surrounding edge surface 39 on top of the board 3, which is sized to receive the mounting flange 29 of the positioning means.

Preferably, the sleeve 31 which is of the same rectangular shape as the box 27 is integrally provided with an internal supporting flange sized to receive and support the bottom edge of the box 27.

Means are also provided for releasably connecting the propulsion and seat unit 7 to the board 3 after insertion of the box 27 within the opening 33 made in the board 3. In accordance with the invention, these means for releasably connecting the propulsion and seat unit 7 to the board 3 are also of the self-binding type, thereby making connection of the propulsion and sat unit to the board very quick and easy to carry out.

As is better shown in FIGS. 4 to 6*b*, such means includes a rigid tab 41 that part of the sleeve 31 defining an opening 33. This rigid tab 41 is positioned and sized to retain the flange 29 of the propulsion and seat unit onto the surrounding edge surface 39 adjacent one 43 of the opposite sides of the box 27.

A resilient locking tab 45 is located at the other one 47 of the opposite sides of the box 27 for snapping this other side 47 to the sleeve 31 after full insertion of the box 27 within the opening 31 and positioning of the flange 29 within the recess defining the surrounding edge mounting surface 39.

In the illustrated embodiment, the resilient locking tab 45 is integral to the sleeve 31 and defines a hook 49 positioned to fit into a corresponding groove 51 provided in the adjacent side 47 of the box 27. However, the tab 45 could be integral to the box 27 and positioned to fit into a groove provided in the sleeve, if such is wanted.

Of course, an access opening 53 is provided adjacent to the side 47 of the box 27 to give manual access to the resilient locking tab 45 and allow release of the same.

Preferably, this access opening 53 extends through the above the locking tab 45, even though it could, if desired, extends through the board top surface of the box 27 and sleeve.

Referring back to FIGS. 1 and 2, the steering unit 9 includes a vertical shaft 61 having a top end and a bottom end 63. A handle bar 65 extends transversally on top of the shaft and a retaining ring 67 radially projects from this shaft at a distance from its bottom end 63. The steering unit 61 also includes a rudder 69 and means for releasably connecting this rudder 69 to the bottom end 63 of the shaft. For this purpose, once again, in accordance with the invention, the means for releasably connecting the rudder 67 to the bottom end 63 of the shaft 61 are of the self-binding type, thereby making connection of this rudder to a shaft easy to carry out after the bottom end of this shaft has been inserted into a bore 60 provided for this purpose in the board at a distance forwards from the opening 3. As may be understood, this bore 60 is sized to receive the bottom end of the shaft which is rotatably retained therein by means of the retaining ring 67.

Figure 7:
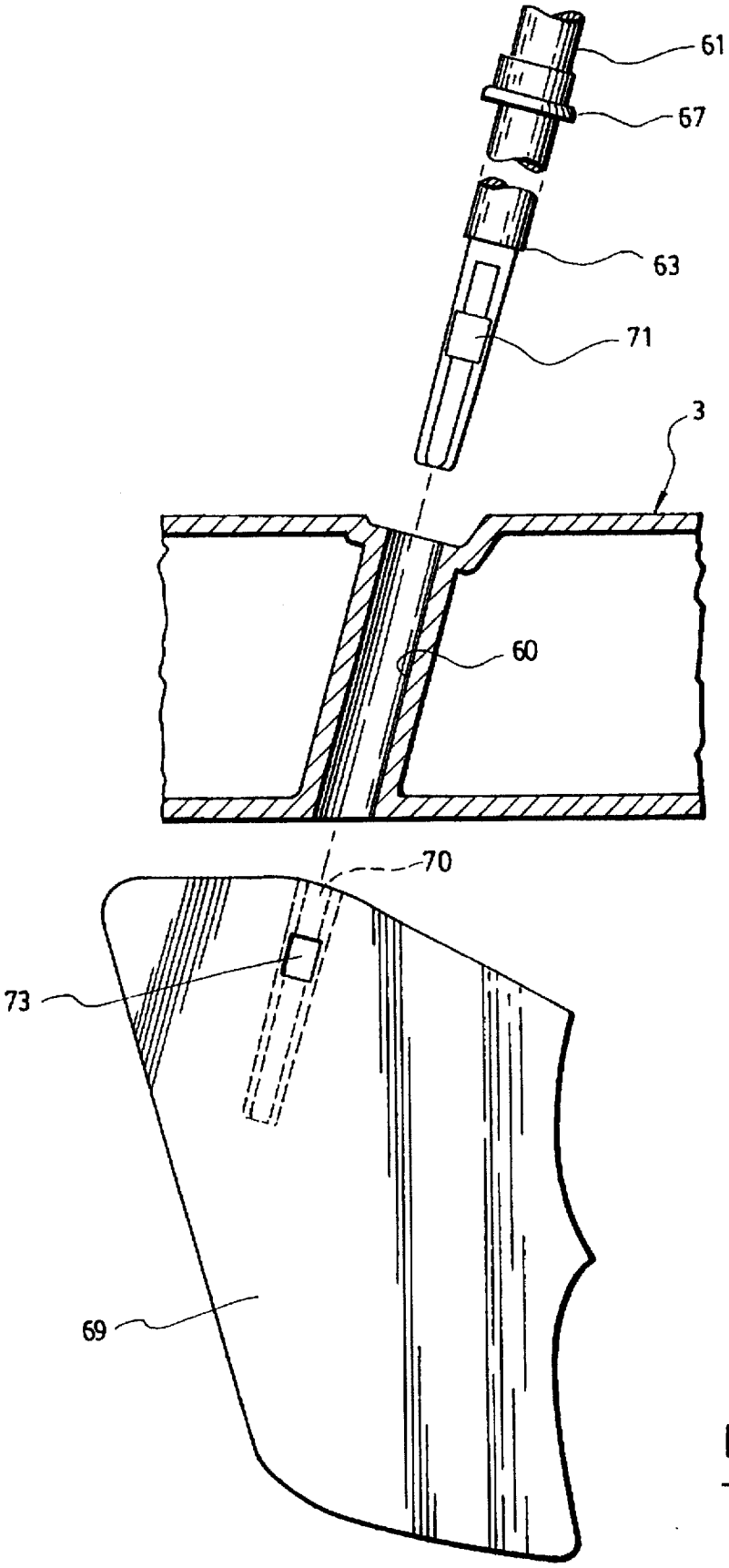
FIG. 7 is an exploded, side elevational, cross-section view of the bottom portion of the steering unit and the way it can be installed onto the board.
Figure 8:
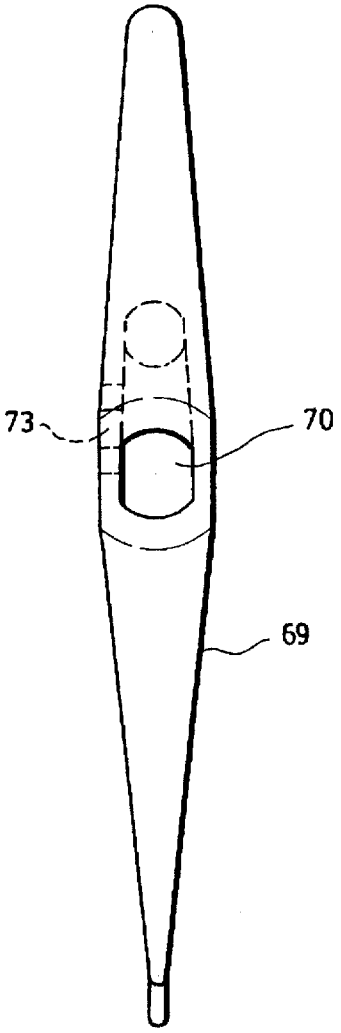
FIG. 8 is a top plan view of the rudder of the steering unit.

In the illustrated embodiment (see FIGS. 7 and 8) the rudder 69 comprises a fixation hole 70 for receiving the bottom end 63 of the shaft and the means for releasably connecting the rudder to the bottom end of this shaft include a resilient locking tab 71 preferably made of plastic material, that radially projects from the shaft 61 close to the bottom end 63 of the same. A transversal through-hole 73 is made in the upper portion of the rudder 69 so as to intersect the fixation hole 70. In use, the locking tab gets snapped into the through-hole 73 and may be released upon application of an external pressure that can be exerted by a finger inserted into the through-hole 73.

Preferably, the bottom end 63 of the shaft 61 and the fixation hole 70 of the rudder 69 are of a corresponding non-circular shape so as to ensure proper fitting of the rudder in a plane perpendicular to the handle bar 65 and shaft.

Figures 6A, 6B, 6C:
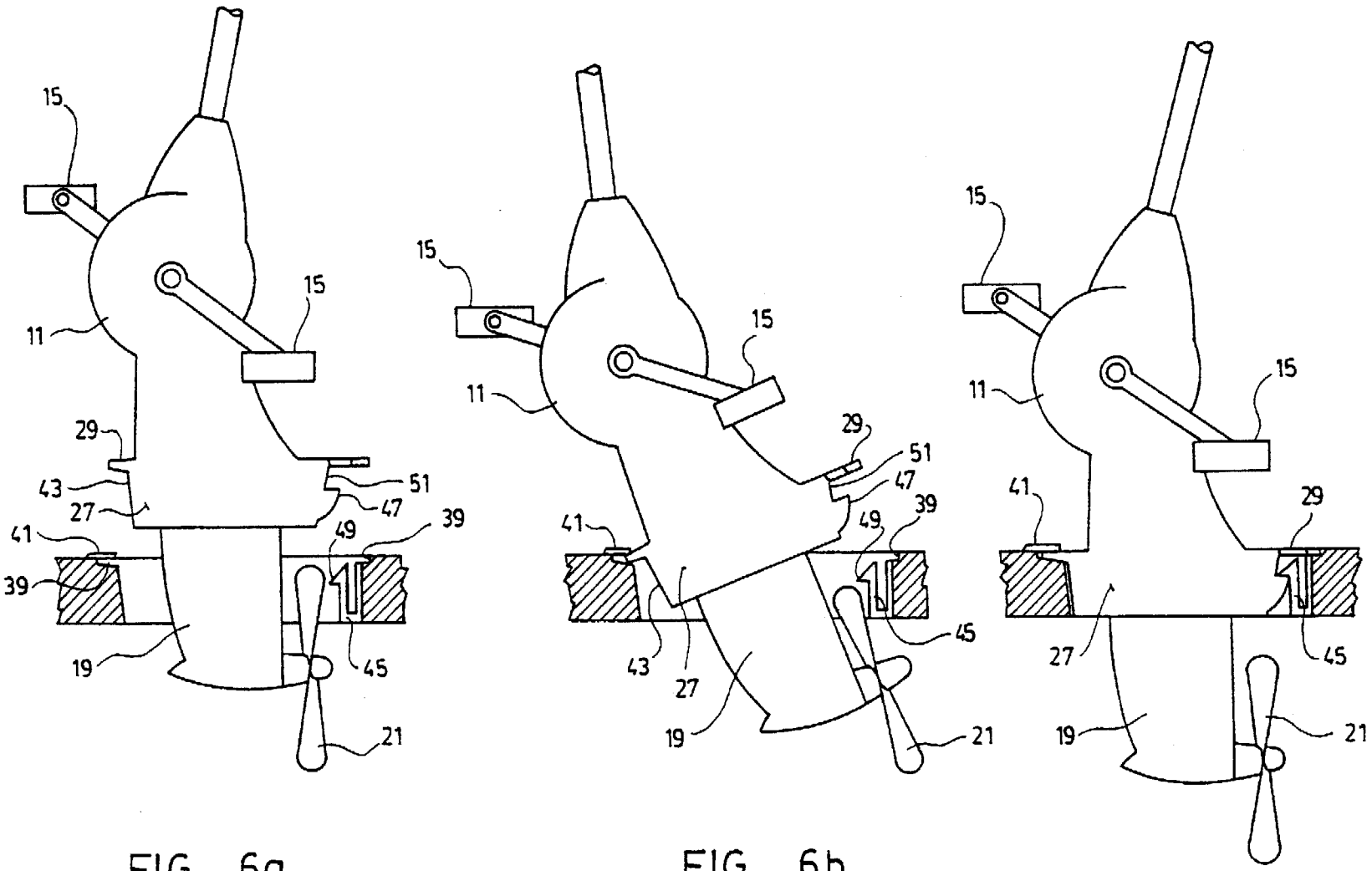
FIGS. 6*a* to 6*d* are schematic side elevational views showing different steps of installation of the propulsion unit into the sleeve.
Figure 6D:
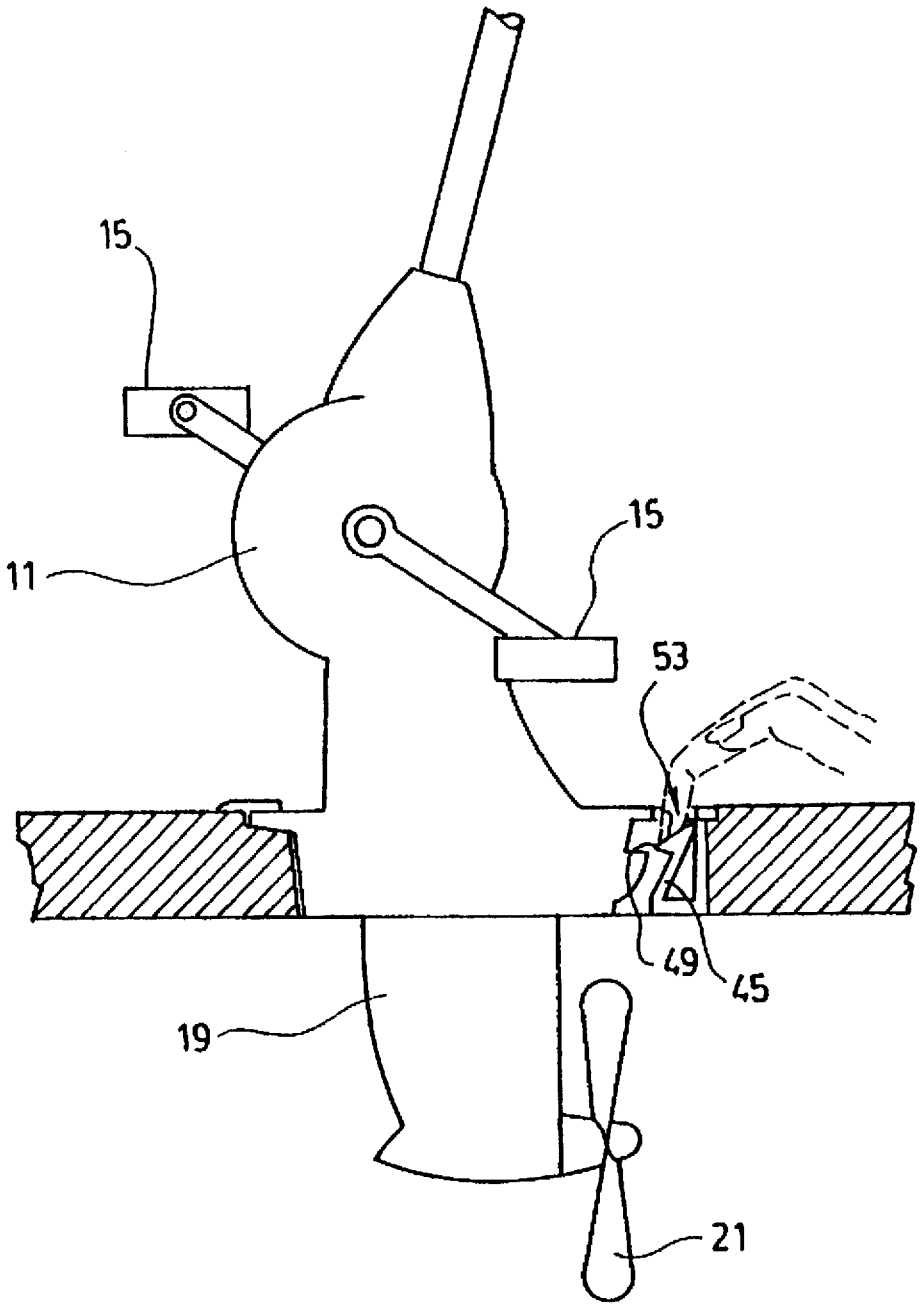
Figure 9A:
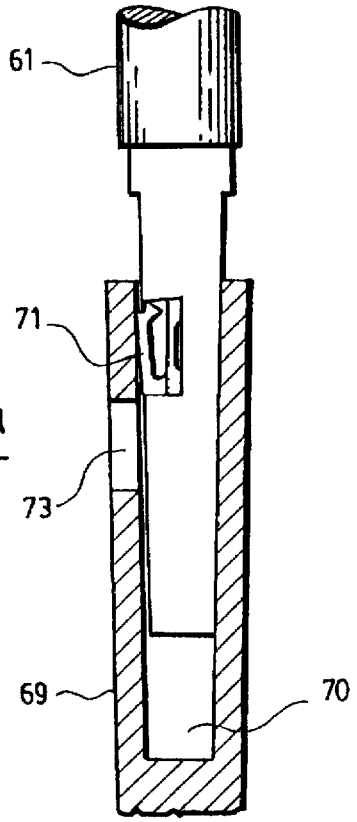
FIGS. 9*a* and 9*b* are schematic side elevational view showing the installation of the bottom end of the shaft of the steering unit into the rudder.
Figure 9B:
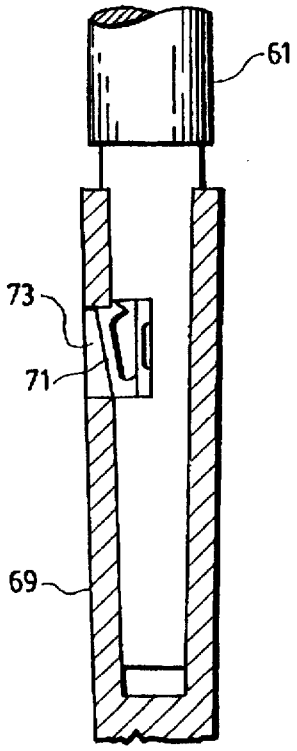

As can now be understood, the assembly and disassembly of both units 7 and 9 onto the board 3 are fast and very easy to carry out. Indeed, one has just to insert the bottom end of the shaft 61 into the bore 60 and then snap thereto the rudder 69, as is shown in FIGS. 9*a* and 9*b*, and subsequently insert the lower body portion of the unit 7 through the opening 33 and snap the box 27 into the sleeve 31, as is shown in FIGS. 6*a* to 6*c*. Similarly, disassembly can very easily be carried out with no tool (see FIG. 6*d*).

As can be noted, no hooks or tabs project from the board 3. Thus, there is no risk of scratching of the surrounding material and no risk of damages to the snap connection means.

Of course, numerous modifications could be made to the preferred embodiments of the invention as it was described hereinabove without departing from the scope of the appended claims.

I claim:

1. In a water bicycle comprising:

an elongated floatation board having a bow, a central portion and a stern;

a propulsion and seat unit including an upper body portion, a seat fixed on top of said upper body portion, foot pedals connected to a crank gear fixed into said upper body portion below the seat for use by a person sitting on said seat, a lower body portion, a propeller operatively mounted onto the lower body portion, coupling means for operatively connecting the crank-gear to the propeller, and positioning means including a mounting flange protecting outwardly from the unit between the upper and lower body portions thereof;

means defining an opening in the central portion of the board through which the lower body portion and propeller may pass, said opening being sized to snugly receive said positioning means and including a recess defining a surrounding edge surface on top of the board, which is sized to receive the mounting flange of said positioning means;

means for releasably connecting the propulsion and seat unit to the board after insertion of sad positioning means within the opening made in said board;

a steering unit including a vertical shaft having a top end and a bottom end, a handle bar extending transversally on top of the shaft, a retaining ring radially projecting from said shaft at a distance from its bottom end, a rudder, and means for releasable connecting the rudder to the bottom end of the shaft; and means defining a bore in the central portion of the board at a distance forwards from the opening, said bore being sized to receive the bottom end of the shaft which is rotatably retained therein by means of the retaining ring;

the improvement wherein:

the rudder comprises a fixation hole for receiving the bottom end of the shaft;

the means for releasable connecting the rudder to the bottom end of said shaft includes a resilient locking tab radially projecting from the shaft close to the bottom end of the shaft and a transversal through-hole which is made in the rudder so as to intersect the fixation hole and in which the locking tab gets snapped and may be released upon application of an external pressure;

the positioning means of the propulsion and seat unit has a pair of opposite sides; and the means for releasable connecting the propulsion and seat unit to the board includes;

a rigid tab forming part of said means defining an opening, said rigid tab being positioned and sized to retain the flange of the propulsion and seat unit onto the surrounding edge surface adjacent one of said opposite: sides of the positioning means;

another resilient locking tab located at the other opposite, side of the positioning means for snapping said other opposite side to the means defining an opening after full insertion of the positioning means within said opening and positioning of the flange within the recess defining the surrounding edge mounting surface; and an access opening provided adjacent to the other opposite end of the positioning means to give access to the resilient locking tab and allow release of the same whereby, in use, connection of said rudder to said shaft is easy to carry out after the bottom end of said shaft has been inserted into the bore in the board and connection of said propulsion and seat unit to the board is very quick and easy to carry out.

2. The improved water bicycle of claim 1, wherein the bottom end of shaft and the fixation hole of the rudder are of a corresponding non-circular shape so as to ensure proper fitting of the rudder in a plane perpendicular to the handle bar and shaft.

3. The improved water bicycle of claim 1, wherein:

said means defining an opening includes a rectangular sleeve rigidly fixed to the board;

said positioning means includes a rectangular box that is shaped to fit into the rectangular sleeve;

said another resilient locking tab is integral to the sleeve and defines a hook positioned to fit into a corresponding groove provided in the adjacent side of the box; and said access opening extends through the positioning means above the other locking tab to give manual access to the same.

4. The improved water bicycle of claim 3, wherein the rectangular box has a bottom edge and the rectangular sleeve has an internal supporting flange sized to receive and support the bottom edge of the box.

5. The improved water bicycle of claim 4, wherein the bottom end of shaft and the fixation hole of the rudder are of a corresponding non-circular shape so as to ensure proper fitting of the rudder in a plane perpendicular to the handle bar and shaft.

6. The improved bicycle of claim 5, wherein the coupling means of the propulsion and seat unit includes a chain interconnecting the crank gear to a sprocket connected to the propeller said chain being held under tension by an adjustable pad and being twisted along a linear portion thereof so as to allow direct connection of the crank gear to the sprocket in spite of their respective axial positions.

7. The water bicycle of claim 6, wherein the propeller consists of a two-blade in-line propeller able to pass easily through the opening when oriented vertically.

* * * * *